United States Patent [19]

Anizan et al.

[11] 4,261,799

[45] Apr. 14, 1981

[54] ELECTROLYTIC PROCESS FOR GENERATING ERASABLE PICTURES ON A SOLID SUBSTRATE

[76] Inventors: Paul Anizan, Bâtiment A2 - Résidence d'Armor, ZUP 22300 Lannion; Yvon Bessonnat, Lotissement Communal de Ker Maria - Seulard, 22450 La Roche Derrien; Marie-Thérèse Riou, Rue d'Estienne d'Ouves, 22700 Perros-Guirec, all of France

[21] Appl. No.: 68,961

[22] Filed: Aug. 23, 1979

[30] Foreign Application Priority Data

Aug. 29, 1978 [FR] France ..... 78 25803

[51] Int. Cl.[3] ..... B41M 5/20

[52] U.S. Cl. ..... 204/2

[58] Field of Search ..... 204/2

[56] References Cited

U.S. PATENT DOCUMENTS

| | | | |
|---|---|---|---|
| 2,897,037 | 7/1959 | Tolf | 204/2 |
| 3,087,869 | 4/1963 | Hamm | 204/2 |
| 3,138,547 | 6/1964 | Clark | 204/2 |
| 3,516,911 | 6/1970 | Hopps, Jr. | 204/2 |
| 3,597,332 | 8/1971 | Richards | 204/2 |
| 4,035,244 | 7/1977 | Inque | 204/2 |

FOREIGN PATENT DOCUMENTS 2001283 7/1978 United Kingdom .

OTHER PUBLICATIONS

Reviews of Modern Physics, vol. 20, No. 1, Jan. 1948 pp. 131–142.

Fujitsu, Scientific & Technical Journal, Sep. 1976, vol. 13, No. 3, pp. 131–140.

IBM Technical Disclosure Bullletin, vol. 17, No. 10, Mar. 1975, pp. 3148–3150.

*Primary Examiner*—T. M. Tufariello

*Attorney, Agent, or Firm*—Laff, Whitesel & Rockman

[57] ABSTRACT

An electrolytic process generates erasable pictures on a solid electrolyte substrate to electrically record data without consumption of energy. The substrate is electrically erasable at will, and then is capable to record data again, and usable as well in telecopy receiver apparatus as display screen. The recording may be made by using an unwearable electrode made of a metal and using a low voltage power supply, for instance under 10V, and a small current. The substrate is substantially unsensitive to ambient light. An electrolytic process locally generates an optical absorption at the surface of an electric conductive layer connected to an anode. The layer has an optically diffusing powder and a metal compound, the amount of which is relatively small. The optical absorption is produced at the contact point between a supplied cathode and the surface by means of a reduction of the metal compound.

13 Claims, 3 Drawing Figures

ELECTROLYTIC PROCESS FOR GENERATING ERASABLE PICTURES ON A SOLID SUBSTRATE

Figure 1:
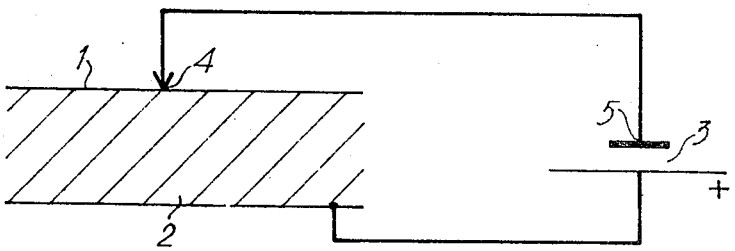

The present invention relates to an electrolytic process for generating erasable pictures on a solid substrate, such as a recording paper. The process is particularly usable in copy or telecopy apparatus and pictures display screens.

The general principle of generating picture by means of electrolysis is well known. It comprises two electrodes contacting a medim containing ions, such as an electrolyte, which provides electric conductivity. When current flows between the electrodes and through the said medium, electrons are exchanged between electrodes and medium, which results in reduction reactions at the cathode and oxidation reactions at the anode. Thus changes may be produced that are capable of altering color in the assembly. When reversible reactions are used, it is sufficient to reverse the current direction in order to destroy the created changes and thus to restore the initial condition. Then the picture is erased.

The advantages of electrolytic processes for generating pictures include the possibility of using rather low voltages, under 10 V, and they usually provide reaction reversibility. Indeed, in other type of electric picture generation, such as a xerographic process wherein an insulated surface is charged, voltages above 1000 V are used; or, if the process is such as a sparking process, voltages above 100 V are used. In a thermal effect recording process, low voltages may be used, but the heated, then colored paper areas are not erasable. Furthermore, it is recalled that with usual screens, (such as CRT screens, laser scanning screens or liquid crystal screens), the picture is erased as soon as a power supply is turned off. On the contrary, a picture created by an electrolytic process is a permanent picture (with respect to continuing power supply) which is very important in the involved fields of applications.

Among electrolytic recording processes, one may cite those involving ionic reaction with an electrode. Thus there is a process using either an iron electrode or a copper electrode in combination with a recording paper containing a chromogen agent, such as diethyl dithiocarbamate. Another process uses a silver anode with recording paper containing a reduction agent, silver ions being released from the anode due to electric current, and reduced to the form of a visible metal picture on the recording paper. In those processes, the recording paper has to be maintained in a wet condition, which implies important drawbacks. Moreover the picture is not erasable. In the French Pat. No. 2 289 946, in order to avoid a utilization of a wet recording paper, a process uses an electrode made of a soli electrolyte. But, the generated picture is not erasable.

In addition, it must be well understood that, in electrolytic processes wherein a metal layer is produced that creates the contrast, as in the above mentioned processes, an important electric power is needed which leads to a use of a low-voltage high-intensity electric current. Indeed, for reacting an ion-gram or material 96,500 coulombs are needed. Thus, for example, a deposit of a one-micron thick silver layer on a European A4-standard sheet of paper, i.e. 1/15 $m^2$, needs 600 couplombs, which means a current intensity of 6 Amps for a recording time of 100 seconds. Such a high current intensity loses some of the advantage obtained in operating under low voltage, particularly as far as the possibilities of miniaturizing apparatus using those processes are concerned.

In an attempt to overcome the problem raised by high electric current, as just mentioned above, solutions have been proposed wherein thinner metal layers are used. For instance, the French patent application No. 77 20774, describes an electrolytic cell containing a silver compound in a non-aqueous solution. When current flows, it produces a silver deposit onto a transparent electrode forming a wall of the electrolytic cell. Contrast is due to a metal silver layer. However, that layer is visible only after having amplified coloration by means of interferences, in very delicate operation conditions. Erasing is produced by silver dissolution, by inverting electrode polarities. In practice, a required liquid screen is difficult to embody on paper for use in a telecopier.

French patent application No. 77 24144, describes a dry electro-sensitive recording sheet made of a conductive sheet having a conductive surface which is covered with an electro-sensitive layer that includes a catalyst material capable of reducing silver ions and a binder wherein catalyst material is dispersed. In practice, the paper is coated with $TiO_2$ (anatase) and recording is produced by means of a silver electrode, the metal of which is oxidized into ions $Ag^+$. Then ions $Ag^+$ are reduced into $Ag^\circ$ when illuminated $TiO_2$, which produces the coloration. A result is that electrolysis operates only in inserting ions $Ag^+$ at desired places in the paper. The proper coloration is then produced by a photochemical effect. Pictures generated by such a process are temporarily erasable by electrolytically reoxidizing silver into $Ag^+$, but the effect cannot last because $TiO_2$ reduces those ions again and the old picture is restored. Furthermore, in operation the silver anode may react with existing anions and become polluted which disturbs electric current flow. Then, the silver anode must be cleaned in reversing the poles which makes the apparatus more complicated. Finally, a silver anode rubbing paper no longer resists abrasion. Still, in addition, use of photosensitive oxides, such as $TiO_2$, needs be developed under light rich in ultraviolet radiations, which makes the process more complicated and slower. The picture may also become degraded if it stays in ambient light.

Still to be noted, in certain circumstances sufficient contrasts may be obtained with very small quantities of materials, without resorting to amplifications by physical processes—interferences—or chemical processes—catalysis photosensitivity. This is particularly true with silver when it is in the form of very finely divided particles called "micelles". Such a phenomenon has been described in a technical article entitled "Reversible Photolysis of Ag sorbed on Collodial Metal Oxides" by A. Goetz and E. C. Y. Inn, published in the American review "Reviews of Modern Physics", Vol. 20, No. 1, January, 1948, pages 131–142. In experiments described in this article, a white powder of ZnO or $TiO_2$, anatase or rutile, is mixed with $Ag_2O$. Despite the fact that $Ag_2O$ is black, the finished plates look white, because there is only a small quantity of $Ag_2O$, i.e. about 1% of the white powder. When those plates are illuminated with actinic light, they are highly blackened due to the creations of silver micelles on white powder particles. In those experiment, a reduction of $Ag^+$ to $Ag^\circ$ does not result from electrolysis, but from photochemical properties of oxides, such as ZnO and $TiO_2$, which become an oxide reducer when exposed.

An object of the present invention is to provide an electrolytic process for generating erasable pictures on a solid sheet, which overcome the drawbacks of the already known processes.

Another object of this invention is to provide a solid electrolyte substrate implementing the process to electrically record data, then to permanently store written data without consumption of energy. However, the substrate is electrically erasable at will, and then is able to record data again, and usable as well in the telecopy receiver apparatus at a display screen.

Another object of this invention is to provide a substrate whereon a recording may be made by using an unwearable electrode made of a metal, that is not necessarily a noble metal, needing only a low voltage power supply, for instance under 10 V, and a small current intensity.

Another object of this invention is to provide a substrate on which recorded pictures are substantially unsensitive to ambient light.

According to a feature of the present invention, an electrolytic process locally generates an optical absorption at the surface of an electric conductive layer connected to an anode. The layer is comprised of an optically diffusing powder and a metal compound, the amount of which is relatively small, the optical absorption being produced at the contact point between a supplied cathode and the surface by means of a reduction of metal compound into micelles.

According to another feature, the optically diffusing powder is not photosensitive in natural light and usual artificial lights.

According to another feature, the optically diffusing powder is white.

According to another feature, the optically diffusing powder is made of a mineral oxide.

According to another feature, the mineral oxide is $GeO_2$, $Al_2O_3$ or $SiO_2$.

According to another feature, the mineral compound is not a photosensitive silver compound.

According to another feature, the mineral compound is the silver oxide $Ag_2O$.

According to another feature, the electric conductive layer includes, in addition, an electrolyte.

According to another feature, the electrolyte is an aqueous solution.

Figure 2:
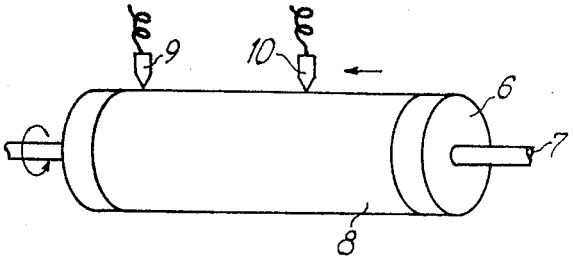
Figure 3:
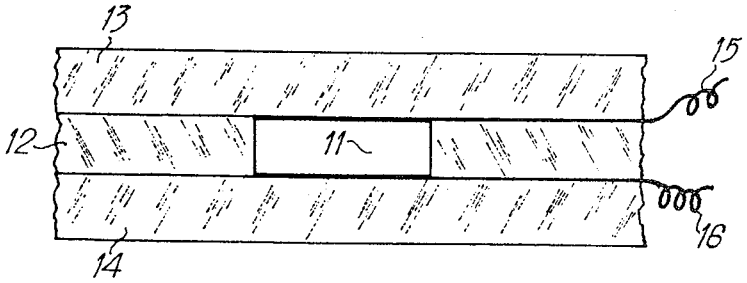

The above mentioned features of this invention, as well as others will appear more clearly from the following description of embodiments implementing the process according to this invention, the description being made in conjunction with the accompanying drawings, wherein:

FIG. 1 is a schematic cross-sectional view of a layer cooperating with electrodes to implement the process according to this invention, FIG. 2 is a schematic perspective view of a recording apparatus which is usable in a telecopy system, and FIG. 3 is a schematic cross-sectional view of a display cell in a display screen, according to this invention.

For implementing the process according to this invention, there is deposited on a surface, a layer basically comprising a white color metal oxide, such as $GeO_2$, $Al_2O_3$ or $SiO_2$, which has no photochemical properties under usual lights. This white metal oxide is mixed with a non-photosensitive metal salt, such as a silver salt or silver nitrate, and an electrolyte that would practically be a solvent used to dissolve silver nitrate. Usually the electrolyte is aqueous and has a predetermined pH. For instance, the electrolyte may be a soda solution. The electrolyte wets the metal oxide particles. Superficially adsorbed, it is stable and renders the metal oxide layer more cohesive. Regarding metal salt, the silver salt has been cited only by way of example. Indeed, any metal salt or complex is suitable provided, of course, that it is compatible with the metal oxide and particularly, once reduced during electrolyzing, generates a colloidal metal that is easily adsorbed on the metal oxide particles.

In recording operation, the rear layer side is, for instance, connected to an anode. The point or more generally an adequate surface, of a cathode is applied onto the other layer side. Since the layer is conductive due to the electrolyte, electric current passes through the silver salt. In the area where the cathode is contacting the layer, the silver salt is reduced so that silver, as in experiments described in the A. Goetz and E. C. Y. Inn's article, is reduced into micelles that create optical absorption spots at the surface of the metal oxide particles. Thus, each point contacted by the cathode becomes black.

When the current direction is reverses between electrodes, the previous cathode becomes positive. If it is in contact with a previously blackened point, micelles are oxidized at that point to restore the initial white color metal compound. Thus, erasing is produced.

The electrolytically active powder layer may also include additives capable of rendering an implementation of the process and making the coating easier. Thus, an additive may be a ionizing liquid, such as water or an alkaline solution, that facilitates electrolysis and ionic migrations, provided that such a liquid does not dissolve the powder or the metal compound to a large extent. As already mentioned, the layer may also include a salt or another compound that is soluble in the ionizing liquid and thereby render the wanted chemical reactions easier. Thus, for instance, soda creates $Ag_2O$ from silver salts. For instance, with silver nitrate, the reaction is:

$$2\ AgNO_3 + 2\ NaOH \rightarrow Ag_2O + 2\ NaNO_3$$

Obviously any disturbing compound must be precluded, such as halogenides that would lead to:

$$Ag_2O + 2\ NaCl \rightarrow 2\ AgCl + Na_2O$$

thus eliminating the wanted product, i.e. $Ag_2O$.

Of course ionizing liquid and salt have to be selected, depending on the nature of the metal compound.

Furthermore, the layer may includes any additive usually used with paper, as particularly ethyl cellulose that insures a certain moisture inside the layer by absorbing atmosphere humidity, without modifying the implemented oxidoreduction reactions. Paper coating may also be improved by an additive, due to its viscosity, etc.

Regarding implementation of the electrodes, it is to be noted that the electrode serving to write will necessarily be the cathode. Indeed, oxide $Ag_2O$ produced in the above mentioned reaction will be reduced according to the following reaction:

$$\underset{\text{electron from cathode}}{Ag^+ + e^-} \longrightarrow \underset{\text{micellar}}{Ag^\circ}$$

to become colloidal. Thus at the cathode an intense coloration is formed due to silver micelles adsorbed in the medium and causing an important light diffusion, even when the micells form a very thin layer, for instance of some tens of angstroms. Therefore, and contrary to most of the existing processes, the cathode may be made of a non-noble metal and there will be no cathode consumption. Particularly the recording cathode may be mode of stainless steel, molybdenum, tungsten, iron, etc., those metals being particularly well-suitable. Obviously the cathode metal will not be soft, to avoid wearings due to abrasion at the contact with recording layer, particularly when the cathode point rubs on the recording layer.

Regarding the erasing operation, when it is needed, the writing electrode becomes an anode to produce a reverse reaction with respect to the above described reaction. Therefore the erasing electrode must be unoxidizable and abrasion resisting. It may be made of a noble metal. It is be noted that the erasing electrode may or may not be an item which is different of the recording electrode. In the latter case, the recording electrode must obviously be unoxidizable and abrasion resisting.

Regardig the counter-electrode, that operates as an anode in recording operation, four different types may be used. It may be included in the basic substrate, as presently in use in some papers provided with conductive layers, basically made of carbon or aluminum. If the paper is rolled round a drum it suffices to ground the drum. Both electrodes—cathode and anode—may lie in a same plane and be made of unixodizable metal, such as platinum or better stainless steel. It may be a metal surface whereon paper together with the electrolytic layer may be set. That metal surface may in stainless steel or coated with a thin layer made of noble metal, when the dielectric properties of the paper allow it to be made so. The anode may be made of sintered or porous material, such as glasses and ceramics, coated with an aqueous liquid that is the actual anode improving electrolysis.

The cross-section shown in FIG. 1 represents an electrolytic layer 1 on a metal surface 2 for use as an anode in a recording operation. Metal surface 2 is connected to the terminal + of an electric current source 3, whose other terminal 5 is connected to a cathode 4, the point of which is in contact with the electrolytic layer 1.

The drum apparatus, shown in FIG. 2, may be used with a telecopy receiver. Rolled on the drum 6 and rotatable about an axis 7 is paper sheet 8 coated with a layer basically comprised of a white powder that is not photosensitive in usual light conditions. For instance, the white powder is a germanium oxide ($GeO_2$) powder. To the white powder is added silver oxide $Ag_2O$ that may be reduced in presence of water. There is a relatively small quantity of silver oxide, for instance 1% in weight, for not altering the white color of the powder. The layer may still have additives, such as those enumerated thereabove. Recording is made by means of a scanning device known in the art, comprising for instance two electrodes 9 and 10 rubbing the layer. Anode 8 is located above the paper area wherein the recording does not occur, such as a border; it is resistive to chemical effects and for instance coated with platinum. Cathode 10 scans the paper sheet; it may be made of any conductive material which is resisting to abrasion, for instance steel.

The cross-section shown in FIG. 3 represents a display screen that is comprised of a plurality of adjacent elementary cells each corresponding to a point. Each cell is constituted by a hole 11 provided in a glass plate 12 and having its opposing sides closed by two glass plates 13 and 14. These two plates are coated in front of each hole 11 with a resistive conductive thin coating, for instance, of gold. Each thin coating is connected either to an electric conductor 15 or 16 respectively. The coating connected to conductor 15 is located on the visible side and is thin enough to be transparent. Hole 11 is occupied by a product having a composition similar to that of layer 1, FIG. 1.

At rest, hole 11 looks white. When current is applied between conductors 15 and 16, with conductor 15 being connected to a pole − and conductor 16 to a pole +. The surface contacting the coating connected to conductor 15 is blackened and hole 11 looks black. Thus, by selecting the conductors to be supplied for the screen cells, a picture is produced that is composed of black points. When reversing the polarities applied to conductors 15 and 16, the surface contacting coating connected to conductor 15 is turned white again, while the other end surface contacting the coating connected to conductor 16 is turned black. The blackened area is of no importance since it is not visible through the thickness of the cell. Thus the recording is erased.

From the above description, it is apparent that the purposes of this invention have been reached.

It is to be noted that up to now only black pictures contrasting with a white background have been considered. However, the powder may be colored with a material which is compatible with the powder composition and which does not disturb the electrolysis phenomena and involved oxidoreduction reactions. The colored material makes it possible to obtain black pictures (or white pictures in reversing rest and work conditions) on colored backgrounds.

What is claimed is:

1. An electrolytic process for generating erasable images on a solid substrate, said process comprising the steps of:

a. forming a first color optically diffusing absorption layer having an optically diffusing powder and a metal compound at the surface of an electrically conductive layer;

b. connecting an electrical potential across a cathode surface in contact with said optically diffusing absorption layer and an anode surface on the back of said layer, c. selectively applying said electrical potential for reducing said metal compound into micelles in the area of contact between said cathode and said layer, thereby creating an image by changing said color at said point of contact; and d. reversing said electrical potential for returning said changed color to said first color at the point of contact, thereby erasing said image.

2. An electrolytic process according to claim 1, wherein the said optically diffusing powder is non-photosensitive in natural light and usual articial lights.

3. An electrolytic process according to claim 2, wherein the said optically diffusing powder is white.

4. An electrolytic process according to claim 1, wherein the said optically diffusing powder is made of a mineral oxide.

5. An electrolytic process according to claim 4, wherein the said mineral oxide is $GeO_2$, $Al_2O_3$ or $SiO_2$.

6. An electrolytic process according to claim 10, wherein the said metal compound is a non-photosensitive silver compound.

7. An electrolytic process according to claim 6, wherein the said metal compound is silver oxide $Ag_2O$.

8. An electrolytic process according to claim 1, wherein the said electric conductive layer includes, in addition, an electrolyte.

9. An electrolytic process according to claim 8, wherein the said electrolyte is an aqueous solution.

10. An electrolytic process for locally generating an optical absorption image at the surface of an electric conductive layer having an anode and a cathode, said layer being connected to an anode, said layer comprising an optically diffusing powder which is a mineral oxide taken from the class of $GeO_2$, $Al_2O_3$ or $SiO_2$ and a non-photosensitive silver metal compound, at least some of said optical absorption occurring at a contact between said cathode and said surface by means of a reduction of said metal compound into micelles.

11. The electrolytic process according to claim 11, wherein the said metal compound is silver oxide $Ag_2O$.

12. The electrolytic process according to claim 11, wherein the said electric conductive layer additionally includes an electrolyte.

13. The electrolytic process according to claim 13 wherein said electrolyte is an aqueous solution.

* * * * *

UNITED STATES PATENT AND TRADEMARK OFFICE

CERTIFICATE OF CORRECTION

PATENT NO. : 4261799

DATED : 4/14/81

INVENTOR(S) : ANIZAN, BESSONNAT & RIOU

It is certified that error appears in the above—identified patent and that said Letters Patent is hereby corrected as shown below:

Col. 1, Line 8, "pictures" s/b --picture--

Col. 1, Line 10 "picture" s/b --pictures--

Col. 1, Line 56 "soli" s/b --solid--

Col. 1, Line 67 "couplombs" s/b --coulombs--

Col. 2., Line 28 "when illuminated $TiO_2$" s/b --in contacting illuminated $TiO_2$--

Col. 2., Line 66, "experiment s/b --experiments--

Col. 3, Line 11 "at" s/b --as--

Col. 5, Line 9, "mode" s/b --made

Col. 5, Line 20, after "it is" insert --to--

Signed and Sealed this

*Twenty-ninth* Day of *September 1981*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,261,799

DATED : April 14, 1981

INVENTOR(S) : ANIZAN, et al.

It is certified that error appears in the above—identified patent and that said Letters Patent is hereby corrected as shown below:

CLAIM 6, Line 1, change "10" to --1--;

CLAIM 11, Line 1, change "11" to --10--;

CLAIM 12, Line 1, change "11" to --10--;

CLAIM 13, Line 1, change "13" to --12--.

Signed and Sealed this

*Thirty-first* Day of *August 1982*

[SEAL]

*Attest:*

GERALD J. MOSSINGHOFF

*Attesting Officer*

*Commissioner of Patents and Trademarks*